US008832872B2

(12) United States Patent
Dudley

(10) Patent No.: US 8,832,872 B2
(45) **Date of Patent: *Sep. 16, 2014**

(54) VALVE FOR EMERGENCY EYE WASH AND RELATED METHOD

(76) Inventor: Gary Dudley, Henderson, NV (US)

( * ) Notice: Subject to any disclaimer, the term of this patent is extended or adjusted under 35 U.S.C. 154(b) by 7 days.

This patent is subject to a terminal disclaimer.

(21) Appl. No.: 13/492,448

(22) Filed: Jun. 8, 2012

(65) Prior Publication Data

US 2012/0240328 A1 Sep. 27, 2012

Related U.S. Application Data

(63) Continuation of application No. 12/412,542, filed on Mar. 27, 2009, now Pat. No. 8,196,235.

(60) Provisional application No. 61/039,865, filed on Mar. 27, 2008.

(51) Int. Cl.
*A61H 33/00* (2006.01)
*A61H 35/02* (2006.01)

(52) U.S. Cl.
CPC ..... *A61H 35/02* (2013.01)
USPC ..... 4/620

(58) Field of Classification Search
CPC ..... A61H 35/02
USPC ..... 4/620; 604/294–302
See application file for complete search history.

(56) References Cited

U.S. PATENT DOCUMENTS

| | | | | |
|---|---|---|---|---|
| 2,032,101 | A * | 2/1936 | Sullivan | 128/200.28 |
| 5,993,428 | A | 11/1999 | Hardge | |
| 6,886,933 | B2 * | 5/2005 | Schwebel | 351/62 |
| 7,011,652 | B1 | 3/2006 | Berke et al. | |
| 2006/0135890 | A1 * | 6/2006 | Tsai | 601/15 |
| 2007/0049913 | A1 * | 3/2007 | Grenon et al. | 606/27 |
| 2010/0122410 | A1 * | 5/2010 | Gourdin | 4/618 |

* cited by examiner

*Primary Examiner* — Huyen Le
*Assistant Examiner* — Janie Christiansen
(74) *Attorney, Agent, or Firm* — Larson & Anderson, LLC

(57) ABSTRACT

An emergency eye wash valve which can be connected to an IV fluid bag or other reservoir of fluid easily controllable flow of liquid to two eye wash arms which are independently positionable to dispense the liquid into the eyes of a patient in need of emergency eye wash. In addition, the valve has a base member which can be affixed via a biocompatible adhesive to the patient (for example on the forehead or bridge of the nose) to hold the valve in position so that it does not have to held in place by a person during the eye washing process.

10 Claims, 5 Drawing Sheets

VALVE FOR EMERGENCY EYE WASH AND RELATED METHOD

RELATED APPLICATIONS

This application claims the benefit of U.S. Provisional Application No. 61/039,865 filed Mar. 27, 2008, which application is incorporated herein by reference.

BACKGROUND OF THE INVENTION

This application relates to a valve that provides a versatile means for providing an emergency eye wash from an IV fluid bag or other container of suitable liquid such as water or saline solution.

The need for an emergency eye wash system can arises in many different environments, including without limitation hospitals, laboratories, police departments and in the home. Whenever a foreign substance, be it soap, mace, or a chemical used in a laboratory contacts the eye, it is desirable to flush the eye with significant volume (for example 1 to 5 liters) of water or other suitable fluid. In some cases where the risk of exposure is substantial, plumbed in eye wash stations may be provided. In other cases, the fluid may be provided from a special reservoir, U.S. Pat. No. 7,011,652 discloses a gravity feeding reservoir connected via a tube to an applicator in the form of an eye cup. Because of the volume of fluid desired, and the relatively low flow rate that is suitable applied into the eye, the delivery of fluid can require a significant period of time. Thus, a device such as that in U.S. Pat. No. 7,011,652 requires either the individual whose eyes are being washed, or some other individual acting as a care provider to hold the applicator in position during the washing procedure. Where the individual is incapable of doing this, and/or where the care providers available may need to attend to other injuries or take other actions more significant that simply holding an eye wash applicator, this can present limitations on the utility of such an approach to providing emergency eye wash.

SUMMARY OF THE INVENTION

The present invention provides an emergency eye wash valve which can be connected to an IV fluid bag or other reservoir of fluid which provides easily controllable flow of liquid to two eye wash arms which are independently positionable to dispense the liquid into the eyes of a patient in need of emergency eye wash. In addition, the valve has a base member which can be affixed via a biocompatible adhesive to the patient (for example on the forehead or bridge of the nose) to hold the valve in position so that it does not have to held in place by a person during the eye washing process, Thus, in accordance with the invention a valve is provided having:

(a) a valve body having an input port and two output ports, wherein liquid flow is controllable between an off position in which no liquid flows through the valve body, and an open position in which liquid flows through the input port and out of the two output ports;

(b) first and second eye wash arms having an interior lumen extending from a proximal end to a distal end, the proximal ends of the first and second eye wash aims each being attached to one of the two output ports, wherein in each of the first and second eye wash arms has a central portion which is bendably deformable to allow the eye wash aims to be independently adjusted in position; and (c) a base portion affixed to the valve body, said base portion comprising a flexible strip having a biocompatible adhesive disposed thereon, whereby when the adhesive is adhered to the forehead or the bride of the nose of the patient the eye wash aims extend outwards from the patient and the central portion of the eye wash aims can be bent to direct fluid into the eye of the patient.

In some embodiments, the first and second eye wash arms comprise fins disposed at the distal ends thereof to facilitate manipulation without making finger-contact with the region through which the eye wash fluid flows when bending the eye wash arms. In some embodiments, the base portion comprises a tab disposed on the side opposite the adhesive to provide a grasping point to facilitate removal of the valve after use.

The present invention also provides a method for providing eye wash comprising the steps of:

(a) connecting a valve such as that described above to a fluid-containing reservoir;

(b) adhering the valve to a patient in need of eye wash treatment, for example to the forehead or the bridge of the nose of the patient;

(c) directing the eye wash arms to provide eye wash solution to the eyes of the patient, and (d) opening the valve to supply eye wash to the patient.

As will be apparent, steps (a) and (b) can be performed in either order, as can steps (c) and (d).

DETAILED DESCRIPTION OF THE INVENTION

Figure 1:
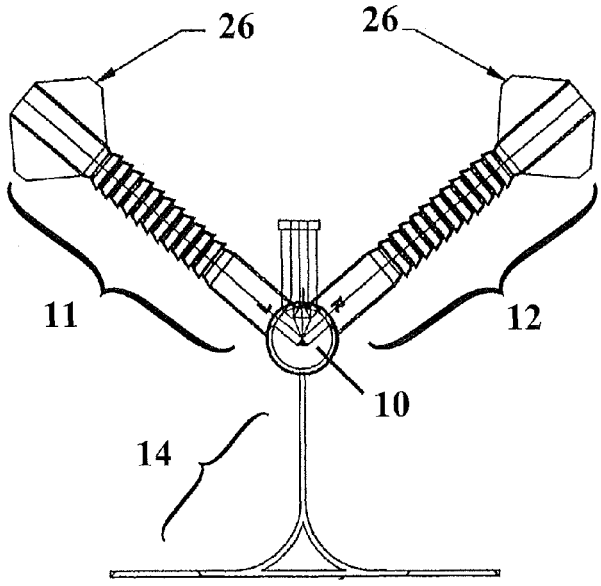
FIG. 1 shows a top view of a valve in accordance with the invention.
Figure 2:
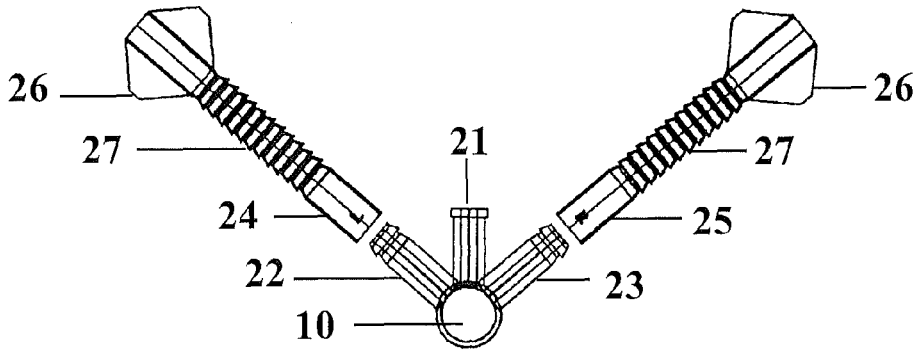
FIG. 2 shows a plan view of the eye wash aims separated from the valve body.
Figure 3:
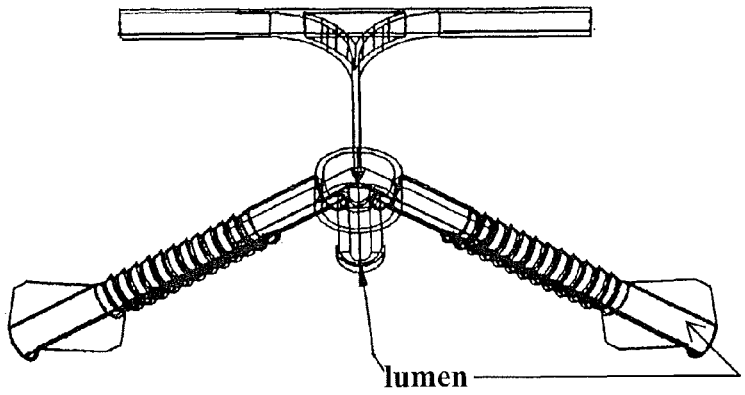
FIG. 3 shows a sectional views through the valve of the invention.

FIG. 1 shows a top view of the a valve in accordance with the present invention. The valve comprises a valve body 10. The valve also comprises first and second eye wash arms 11, 12 and a base portion 14. As more clearly shown in FIG. 2, the valve body 10 has an inlet port 21, and two outlet ports 22, 23. The proximal ends of the 24, 25 of the eye wash arms 11, 12 engage with the outlet ports 22, 23 to connect them with the valve body. The eye wash aims each have a flexible center portion 27 similar to the bendable portion of a flex straw, which allows the arms to bent and held in a selected position to direct the eye wash to the eyes. At the distal ends of the eye wash aims 11, 12 are optional fins 26 which can be used to facilitate grasping the eye wash aims for bending and positioning. FIG. 3 shows a sectional view through the valve of the FIG. 1 in which the lumens within the valve body and the eye wash aims for the passage of liquid can be seen.

Figure 5:
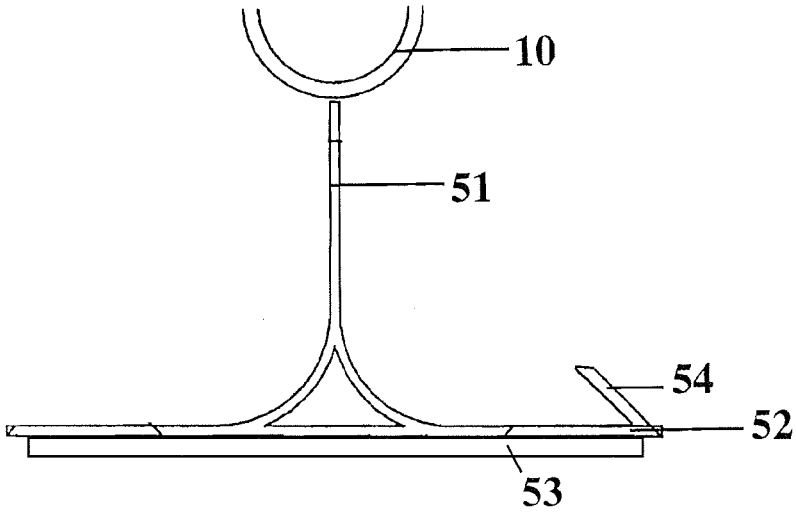
FIG. 5 shows a base portion of a valve in an embodiment of the invention.

FIG. 1 also shows an embodiment of the base portion 14 which is affixed to the valve body 10. The base portion is shown in more detail in FIG. 5. As shown, the base portion has a stem 51 which connects a flexible strip 52 to the valve body 10. A layer of biocompatible adhesive 53 is disposed on the surface of the flexible strip 52 opposite the stem 51. Optionally, a tab 54 can be disposed on the flexible strip 52 to facilitate lifting of the end of the base portion when removal from the skin of a patient is desired.

Figure 4A:
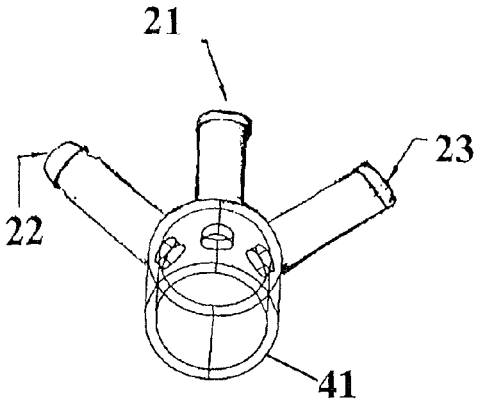
FIGS. 4A, 4B, 4C, and 4D show a valve body in accordance with the invention.
Figure 4D:
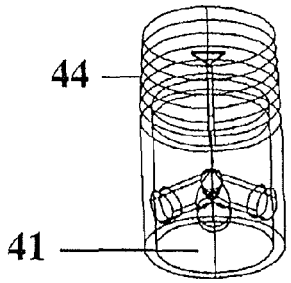
Figure 4B:
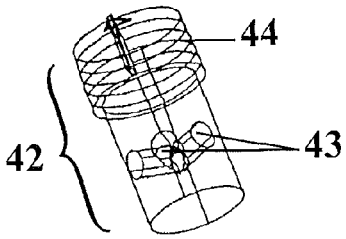
Figure 4C:
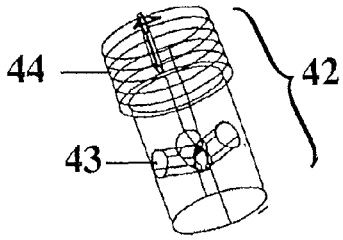
Figure 6:
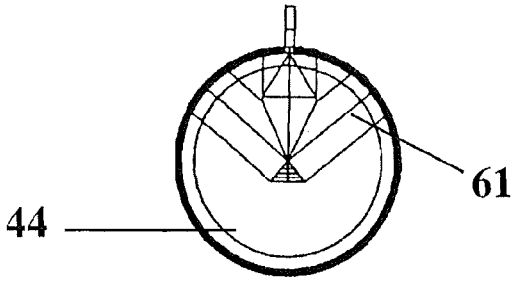
FIG. 6 shows a top view of a valve body in accordance with the invention.

FIGS. 4A-D show details of the valve body 10 which allows control of liquid flow from a reservoir through the valve body to the eye wash arms. FIG. 4A shows the inlet port 21 and outlet ports 22 and 23 and their connection to a fluid chamber 41. In the assembled valve body, a flow control valve 42 (FIGS. 4B and C) is inserted into the fluid chamber 41 as shown in FIG. 4D (with the input and output ports removed for clarity). The flow control valve 42 has an internal chamber and three openings 43 positioned to align with the openings of the inlet and outlet ports in the fluid chamber 42. A knob portion 44 is positioned at one end of the flow control valve. Rotation of the flow control valve relative to the fluid chamber permits closing of the valve by blocking the openings to the inlet and outlet ports. Controlled flow can be achieved by orienting the flow control valve to be completely or partially in alignment with the openings to the inlet and outlet ports. Alternatively, flow to only one eye can be achieved by aligning the middle opening of the flow control valve 42 with the eye wash arm for that eye, and one of the side openings with the inlet port. The top surface of the valve may have markings on it to define the fully aligned position such as the arrow point in FIG. 1, or the positions for washing one eye only, or it may have raised portions 61 as shown in FIG. 6 which permits tactile alignment even by a user who is self administering the eye wash and therefore cannot see.

The valve of the present invention is used to providing eye wash. This method involves (a) connecting the valve such as that described above to a liquid-containing reservoir;

(b) adhering the valve to a patient in need of eye wash treatment, for example to the forehead or the bridge of the nose of the patient;

(c) directing the eye wash arms to provide eye wash solution to the eyes of the patient, and (d) opening the valve to supply eye wash to the patient.

Steps (a) and (b) can be performed in either order, as can steps (c) and (d).

The size of the valve of the invention is not particularly critical, other than that it should be generally small and light weight such that it can be attached to the patient without causing pain or discomfort. By way of non-limiting example, the inlet and outlets ports may suitably be 16 gauge tubing.

Figure 7:
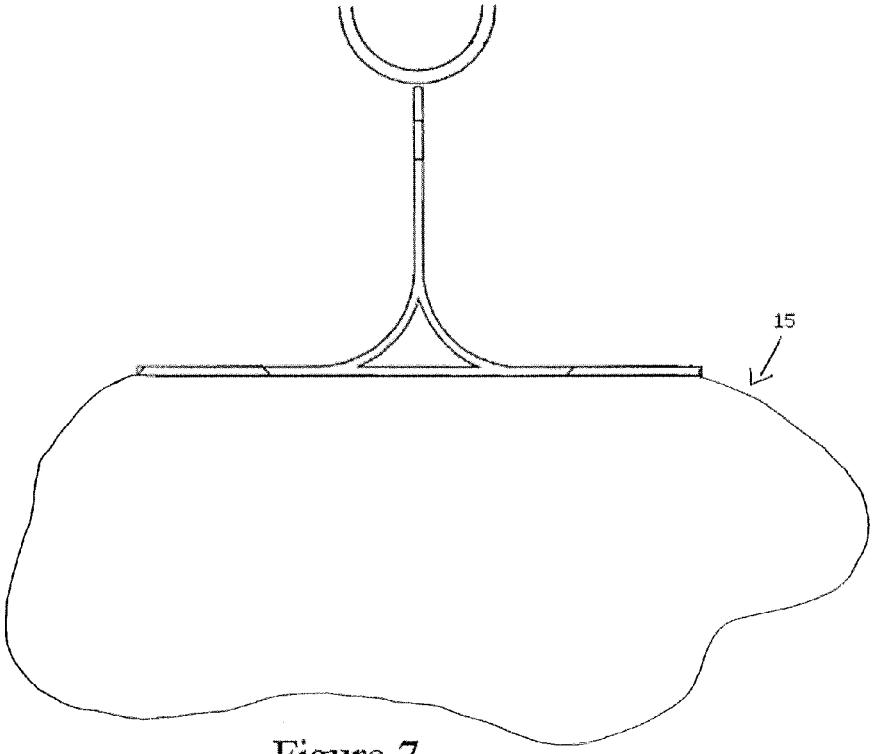
FIG. 7 shows the base portion attached to an elastic band in accordance with the invention.

While the foregoing, describes a preferred embodiment of the invention, variations can be made without departing from the scope of the invention. For example, while the valve is conveniently made with an adhesive as described above, the same benefits of adhering the valve to the patient so that neither the person in need of eye wash treatment nor a care provider need to hold the eye wash system in position can be achieved using an elastic head band 15, as shown in FIG. 7, which is associated with the valve before or after positioning the head band on the patient. The valve could also be associated with s structure similar to an eyeglass frame which would use the patient's ears for positioning and support. The selection of the appropriate support could be made on scene depending on the location and nature of other injuries to minimize pain and potential complications to the patient. Thus, in a more general sense, the base portion of the valve of the invention comprises means for means for affixing the valve body to a patient in a defined location adjacent to the eyes such that the eye wash arms extend outwards from the patient and the central portion of the eye wash arms can be bent to direct fluid into the eye of the patient. Similarly, addition features can be included, such as eye wash valves within the eye wash anus to allow differential control of the flow of liquid in the two eye wash arms. Such valves may in their simplest be a deformable sleeve (for example of light weight metal) disposed around the outside of the eye wash arms that when squeezed constricts one arm compared to the other to restrict flow.

The invention claimed is:

1. An eye wash valve comprising:

(a) a valve body having an input port and two output ports, wherein liquid flow is controllable between an off position in which no liquid flows through the valve body, and an open position in which liquid flows through the input port and out of the two output ports;

(b) first and second eye wash arms each having an interior lumen extending from a proximal end to a distal end of the eye wash arms, the proximal ends of the first and second eye wash arms each being attached to one of the two output ports, wherein in each of the first and second eye wash arms has a central portion which is bendably deformable to allow the eye wash arms to be independently adjusted in position; and (c) a base portion affixed to the valve body, said base portion being attached to an elastic head band for affixing the valve body to a patient in a defined location adjacent to the eyes such that the eye wash arms extend outwards from the patient and the central portion of the eye wash arms can be bent to direct fluid into the eye of the patient, wherein the elastic head band is positionable on the patient, and wherein the valve body comprises a fluid chamber having a flow control valve rotatably disposed therein.

2. The eye wash valve of claim 1, wherein the eye wash arms further comprise a fin disposed at the distal end thereof.

3. The eye wash valve of claim 1, wherein the flow control valve comprises a fluid chamber portion and a knob portion.

4. The eye wash valve of claim 3, wherein the knob portion has raised alignment markings.

5. The eye wash valve of claim 1, wherein the valve further comprises first and second eye wash arm valves disposed to independently control flow through the first and second eye wash valves respectively.

6. An eye wash valve comprising:

(a) a valve body having an input port and two output ports, wherein liquid flow is controllable between an off position in which no liquid flows through the valve body, and an open position in which liquid flows through the input port and out of the two output ports;

(b) first and second eye wash arms each having an interior lumen extending from a proximal end to a distal end of the eye wash arms, the proximal ends of the first and second eye wash arms each being attached to one of the two output ports, wherein in each of the first and second eye wash arms has a central portion which is bendably deformable to allow the eye wash arms to be independently adjusted in position; and (c) a base portion affixed to the valve body, said base portion comprising means for affixing the valve body to a patient in a defined location adjacent to the eyes such that the eye wash arms extend outwards from the patient and the central portion of the eye wash arms can be bent to direct fluid into the eye of the patient, wherein the base portion is configured to be affixed to a structure that spans the patient's face and is supported by the patient's ears, and positioned and supported by the patient's nose, wherein the valve body comprises a fluid chamber having a flow control valve rotatably disposed therein.

7. The eye wash valve of claim 6, wherein the eye wash arms further comprise a fin disposed at the distal end thereof.

8. The eye wash valve of claim 6, wherein the flow control valve comprises a fluid chamber portion and a knob portion.

9. The eye wash valve of claim 8, wherein the knob portion has raised alignment markings.

10. The eye wash valve of claim 6, wherein the valve further comprises first and second eye wash arm valves disposed to independently control flow through the first and second eye wash valves respectively.

* * * * *